United States Patent [19]

Frommann

[11] 4,409,265

[45] Oct. 11, 1983

[54] METHOD AND APPARATUS FOR THE ONE-SIDED COATING OF CONTINUOUS METAL STRIP

[75] Inventor: Klaus Frommann, Dusseldorf, Fed. Rep. of Germany

[73] Assignee: Mannesmann Aktiengesellschaft, Dusseldorf, Fed. Rep. of Germany

[21] Appl. No.: 339,177

[22] Filed: Jan. 13, 1982

[30] Foreign Application Priority Data

Jan. 21, 1981 [DE] Fed. Rep. of Germany ..... 3101760

[51] Int. Cl.[3] ..... B05D 3/12; B05D 1/18; B05D 1/28; B05C 1/00

[52] U.S. Cl. ..... 427/271; 427/368; 427/428; 427/433; 427/367; 427/398.4; 427/277; 118/249; 134/2; 134/38

[58] Field of Search ..... 427/211, 300, 428, 433, 427/271, 277, 368, 367, 275, 398.4; 118/249; 134/2, 38

[56] References Cited

U.S. PATENT DOCUMENTS

| | | | |
|---|---|---|---|
| 2,229,621 | 1/1941 | Bradner | 427/428 X |
| 2,775,954 | 1/1957 | White et al. | 427/428 X |
| 3,429,741 | 2/1969 | Moriarty | 427/428 X |
| 4,120,997 | 10/1978 | Franks et al. | 427/368 X |
| 4,152,471 | 5/1979 | Schnedler et al. | 427/310 |
| 4,172,911 | 10/1979 | Michels | 427/300 |
| 4,239,817 | 12/1980 | Koenitzer et al. | 427/211 |
| 4,291,074 | 9/1981 | Schoeps et al. | 427/368 X |

OTHER PUBLICATIONS

Coating Equipment and Processes-pp. 139-140, Booth, George L., 1970.

*Primary Examiner*—Michael R. Lusignan
*Attorney, Agent, or Firm*—Mandeville and Schweitzer

[57] ABSTRACT

In connection with a coating method and apparatus for one-sided coating of a continuous metal strip, a method and apparatus are provided for the mechanical removal of the oxide layer which forms on the uncoated side of said metal strip after said metal strip leaves the protective environment within which the coating occurs.

10 Claims, 1 Drawing Figure

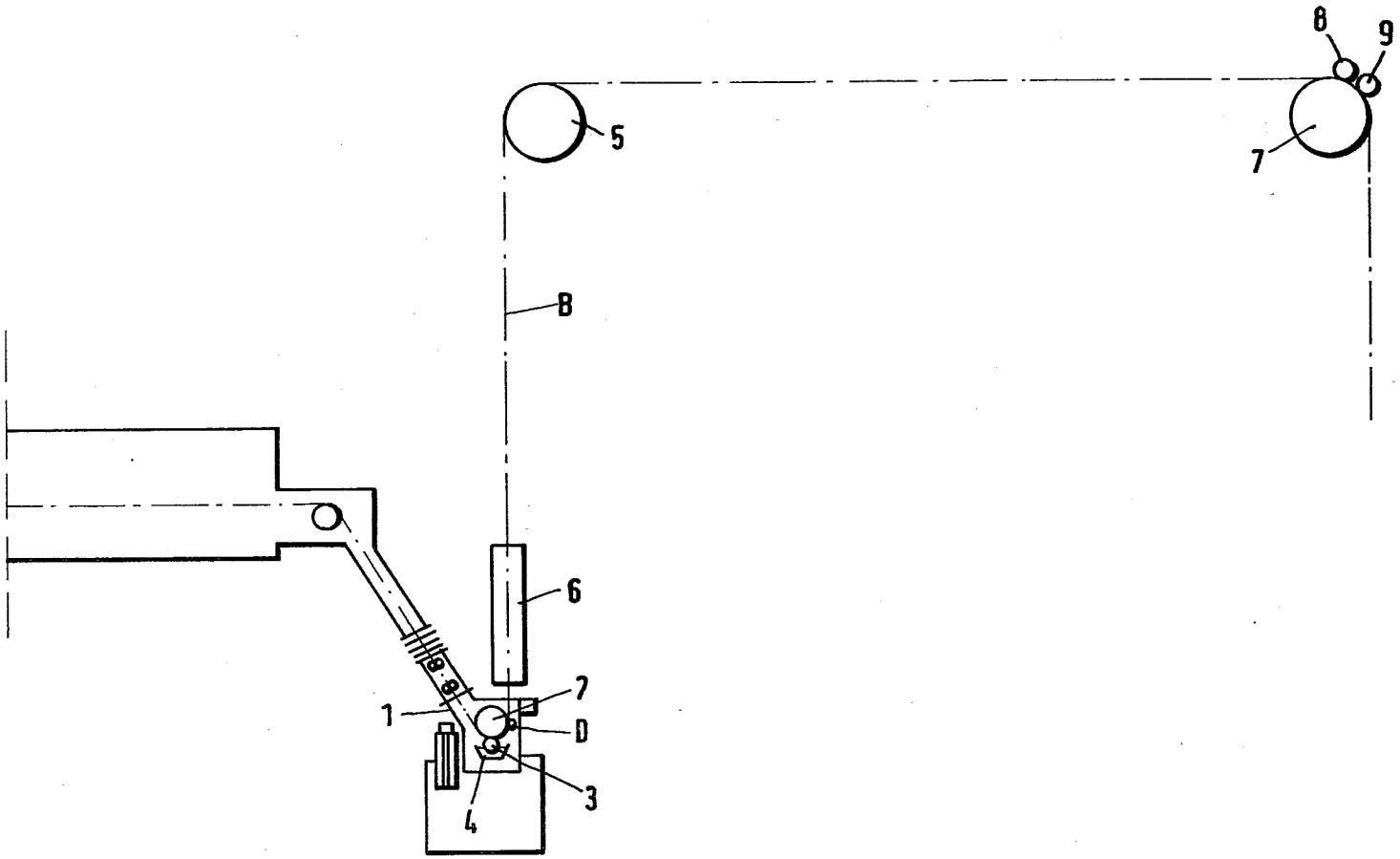
9
8
7
5
8
6
2
D
3
4
1

METHOD AND APPARATUS FOR THE ONE-SIDED COATING OF CONTINUOUS METAL STRIP

BACKGROUND OF THE INVENTION AND DESCRIPTION OF THE PRIOR ART

This invention relates to a method and apparatus for carrying out the one-sided coating of continuous metal strip. The present invention is especially suited for galvanizing steel strip. The steel strip is passed through an inert gas atmosphere, above a liquid coating medium contained in a vessel. The steel strip is directed about a horizontally rotating guide roller. Located below the guide roller and having its rotating axis parallel to the axis of the guide roller is arranged a material feed roller, which dips, with at least half of its circumference, into the coating medium contained in the vessel. The coating medium is supplied to the steel strip in an amount required for the application of the required coating thickness to the surface of the metal strip. The coating material is provided to the sheet metal in a direction opposite to the direction of travel of the metal strip. Downstream of the guide roller, in the direction of transport of the metal strip and downstream of the gap between the surface of the metal strip and the surface of the feed roller, there is arranged an orifice knife, capable of controlling the desired coating layer thickness. Optionally, a mechanism for introducing seed crystals into the coating layer can also be provided which operates by directing a stream of gas to the metal strip. All of the above is described according to U.S. patent application Ser. No. 255,884, filed Apr. 20, 1981, now abandoned, priority being based on German patent application Pat. No. 30 09 590.0-45. U.S. patent application Ser. No. 255,844 accomplishes the specific objective of providing a method and apparatus for the manufacture of a flawless, uniform, one-sided coating of a continuous metal strip. This is accomplished with little relative additional expenditure for construction; yet, nevertheless, the process is able to adjust the coating thickness accurately. In carrying out the process of the referred to pending U.S. patent application, it was discovered that when the coated metal strip left the inert gas atmosphere at too high a temperature, the uncoated back surface of the metal strip would oxidize or tarnish which is disadvantageous for the subsequent processing of the metal strip. The referred to U.S. patent application has already proposed that the inert gas be also used for cooling the metal strip in order to lower the temperature of the coated steel strip into a region in which tarnishing of the back surface no longer takes place prior to introduction of the strip into the atmosphere. However, that solution requires a relatively long cooling zone to be operated under an inert gas atmosphere which obviously corresponds to a relative high capital expenditure.

SUMMARY OF THE INVENTION

Recognizing the oxidation problem and the solution sought to be accomplished by the referred to U.S. patent application, it is an object of the present invention to provide a method and apparatus for coating a metal strip on one side with a clean, that is, not oxidized or tarnished uncoated reverse side.

In order to accomplish the above described objective, it is now proposed that the oxide layer on the surface of the uncoated side of the metal strip be mechanically removed. It is significantly simpler and less expensive from a capital expenditure and construction point of view to allow the oxidation or tarnishing of the back surface to first occur, with the layer then being mechanically removed from the uncoated side of the metal strip, than to attempt to prevent by the use of an enlarged protective gas housing the oxidation of the back of the strip in the first place. Since the tarnished layer exhibits a thickness of only a few microns, its mechanical removal is readily possible with relatively simple means.

To effectuate the removal of the oxide layer, it has been found to be particularly advantageous to provide one or more rotating tools, which act directly on the oxidized surface. Obviously, the rate of rotation of such a tool is to be adjusted so that there is a considerable difference in speed between the metal sheet and the part of the tool acting on the oxidized or tarnished surface of the metal sheet.

According to the preferred embodiment of the present invention, the tool is a metallic or plastic brush. An alternative embodiment of the invention contemplates the use of a synthetic fiber fleece material as the scraping material of the rotating tool which material has been permeated with abrasive particles.

It is, however, also within the scope of the invention to provide a brush with a braided or woven working surface. The only limitation on the latter embodiment is that the brush be firm enough in consistency, so as to remove the tarnished layer.

According to yet another characteristic of the invention, the tools for removing the oxidized or tarnished surface are located outside of the protective housing for the inert gas. In addition, the tool is located a sufficient distance downstream in relation to the running direction of the metal strip, i.e., downstream of the orifice knife or the mechanism for introducing seed crystals so that the strip is cooled prior to mechanical removal of the oxidized layer. It is contemplated that the scraping tool be located at a distance downstream from the material coating gap, so as to allow adequate time for the cooling of the metal strip.

A significant advantage of the present invention is to be seen in the fact that the mechanism for introducing the orienting seed crystals need not, anymore, be provided within the inert gas atmosphere. Rather, this mechanism can now be operated in the normal air atmosphere instead of within the inert gas atmosphere as previously considered necessary. This, too, considerably reduces the total expenditure for the equipment, which previously required rather expensive facilities for recovering the inert gas after it has first been scrubbed.

BRIEF DESCRIPTION OF THE FIGURE

The FIGURE is a cross sectional view of the apparatus used in carrying out the present invention.

DETAILED DESCRIPTION OF THE FIGURE

As shown in the FIGURE, the proposed apparatus is extremely simple to manufacture and uncomplicated in its mode of action. A coated metal strip B which, after circulating around a guide roller 2 is coated with coating material 4 by means of the feed roller 3. The now-coated strip B leaves the housing 1 through an exit 10 (not referenced). The housing serves to maintain the inert gas atmosphere. The existing temperature of the strip will be in the range of about 400° C. By being at that temperature, a tarnished or oxidized layer is formed on the reverse side of the metal strip and causes the metal strip to become discolored, yellow at first and blue-green later. According to the invention, however, the metal strip B is passed around a second guide roller 5. Located between the housing for the inert gas and the guide roller 5 is a mechanism 6 for suppressing the formation of zinc flowers. Located downstream of roller 5 is yet another guide roller 7. The mechanical scraping or abrading tools 8 and 9 are spaced from guide roller 7 so that the surface of the guide roller 7 forms a solid backing for the tools 8 and 9, to facilitate their operation. In the distance between the inert gas housing exit 10 (not specifically numbered on the drawing) and the guide roller 7, the metal strip B has cooled off to such an extent that additional oxidation is stopped. As soon as the metal strip has cooled off to a temperature of about 100° C., its surface will no longer change. At this distance, i.e., the distance required for the desired cooling, two rotating tools 8 and 9 are arranged so as to be supported at right angles to the motion direction of strip B and having their axis of rotation parallel to the plane within which the metal strip travels. These tools can be plastic or metal brushes or can be fleece drums, in which the fleece has been impregnated with abrasive particles. In any event, the tools will, relatively effortlessly, remove the tarnished layer, which is only a few microns thick, so that a flawless back surface of the metal strip is formed.

The teachings of the attached copy of the corresponding German Application, upon which this application claims priority, is herein specifically incorporated by reference.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A method for the one-sided coating of a continuous metal strip, comprising the steps of:

(a) maintaining a vessel of liquid coating material;

(b) directing a metal strip about a horizontally rotating guide roller located above said vessel of liquid coating material;

(c) rotating a feed roller, parallel to said guide roller, and displaced into said vessel by at least half of its circumference;

(d) transferring liquid coating material from said feed roller to one side of said metal strip by rotating said feed roller in the same direction of rotation as said guide roller;

(e) performing said steps (a)–(d) in an inert atmosphere at an elevated temperature;

(f) the temperature of said inert atmosphere being such that said continuous metal strip leaves said inert atmosphere at a temperature of about 400° C.;

(g) controlling the desired coating thickness by use of a metering device; wherein the improvement is characterized by the steps of (h) cooling said metal strip to a temperature of about 100° C. by causing it to travel a distance from said inert atmosphere; and then (i) mechanically removing on oxide layer from the uncoated side of said metal strip.

2. A method as claimed in claim 1, wherein:

(a) said step (h) is performed under normal atmospheric conditions.

3. An apparatus for the one-sided coating of a continuous metal strip comprising:

(a) a horizontally rotating guide roller for guiding said metal strip;

(b) a feed roller, rotating horizontally beneath said guide roller, and rotating in the same direction of rotation as said guide roller;

(c) a vessel containing liquid coating material;

(d) said feed roller being immersed by at least one-half of its diameter into said liquid coating material in said vessel;

(e) said feed roller serving to carry a sufficient quantity of liquid coating material from said vessel to only one side of said metal strip to provide a layer of coating material on only one side of said metal sheet;

(f) said apparatus (a)–(e) being contained in an inert gas housing;

(g) the temperature in said housing serving to raise the temperature of said metal sheet to about 400° C.;

(h) means for selectively controlling the thickness of said layer of coating material, said means being located downstream from said guide roller and said feed roller; wherein the improvement is characterized by (i) means for moving said metal sheet into said housing and away from said housing at a controlled rate;

(j) oxide removal means for mechanically removing an oxide layer from the uncoated side of said metal strip; and (k) said oxide removal means being located downstream from said housing a distance sufficient to allow said metal sheet to cool to a temperature of about 100° C.

4. An apparatus as claimed in claim 3, wherein:

(a) said oxide removal means for mechanically removing an oxide layer is located in the ordinary atmosphere.

5. An apparatus as claimed in claim 3, wherein:

said oxide removal means for mechanically removing an oxide layer is at least one rotating tool which acts on the uncoated side of said metal strip.

6. An apparatus as claimed in claim 5, wherein:

(a) said tool is a brush.

7. An apparatus as claimed in claim 6, wherein:

(a) said brush is metallic.

8. An apparatus as claimed in claim 6, wherein:

(a) said brush is plastic.

9. An apparatus as claimed in claim 5, wherein:

(a) said tool is a fleece of synthetic fibers; and (b) said fleece is impregnated with abrasive particles.

10. An apparatus as claimed in claim 6, wherein:

(a) said brush is provided with a braided surface.

* * * * *